US009196117B2

(12) United States Patent
Kim et al.

(10) Patent No.: US 9,196,117 B2
(45) Date of Patent: Nov. 24, 2015

(54) GAME SUPPORT SYSTEM AND METHOD

(75) Inventors: Ki Yong Kim, Seongnam (KR); Jung Ho Jeong, Yongin (KR)

(73) Assignee: NHN Entertainment Corporation, Seongnam-si (KR)

( * ) Notice: Subject to any disclaimer, the term of this patent is extended or adjusted under 35 U.S.C. 154(b) by 1426 days.

(21) Appl. No.: 12/131,177

(22) Filed: Jun. 2, 2008

(65) Prior Publication Data

US 2008/0300048 A1 Dec. 4, 2008

(30) Foreign Application Priority Data

May 31, 2007 (KR) ..... 10-2007-0053585

(51) Int. Cl.
*G07F 17/32* (2006.01)
*A63F 9/24* (2006.01)

(52) U.S. Cl.
CPC ..... *G07F 17/3244* (2013.01); *G07F 17/32* (2013.01); *G07F 17/3234* (2013.01)

(58) Field of Classification Search
CPC ..... G07F 17/32
USPC ..... 463/25
See application file for complete search history.

(56) References Cited

U.S. PATENT DOCUMENTS

2003/0073494 A1* 4/2003 Kalpakian et al. ..... 463/42
2004/0106454 A1* 6/2004 Walker et al. ..... 463/42
2004/0204231 A1* 10/2004 Martin et al. ..... 463/25
2006/0040735 A1* 2/2006 Baerlocher ..... 463/26
2006/0279044 A1* 12/2006 Pacey ..... 273/292
2007/0060326 A1* 3/2007 Juds et al. ..... 463/29
2007/0060361 A1* 3/2007 Nguyen et al. ..... 463/42
2007/0077994 A1* 4/2007 Betteridge ..... 463/42
2007/0270203 A1* 11/2007 Aida ..... 463/16
2008/0032787 A1* 2/2008 Low et al. ..... 463/29
2008/0076501 A1* 3/2008 Mares et al. ..... 463/13
2008/0096659 A1* 4/2008 Kreloff et al. ..... 463/39
2010/0022308 A1* 1/2010 Hartmann et al. ..... 463/42
2010/0227670 A1* 9/2010 Arezina et al. ..... 463/25

FOREIGN PATENT DOCUMENTS

KR 10-2002-0091631 12/2002
KR 10-2006-0008632 1/2006

* cited by examiner

*Primary Examiner* — James S McClellan
*Assistant Examiner* — Syvila Weatherford
(74) *Attorney, Agent, or Firm* — H.C. Park & Associates, PLC

(57) ABSTRACT

A game support system includes a DB server for storing in a DB user information including a user's unique identification and the user's own money, a web server for posting information about a plurality of game rooms, and a game processing server for admitting the user to a game room selected by the user from among the plurality of game rooms and processing a game in the selected game room. The game support system further includes a participation money designation server for providing an input window to allow the user to designate a part of the user's own money as participation money required for participation in the selected game room. The system, for example, allows the user to continue to play a game without moving out to another portal or game site.

19 Claims, 7 Drawing Sheets

Figure 3

PAY PARTICIPATION MONEY

ROOM INFORMATION
GAME RULE : 2-CARD SUTDA (20 CARDS)
SEED MONEY : 2 BILLION WON
MAXIMUM PARTICIPATION MONEY : 3 TRILLION WON
MINIMUM PARTICIPATION MONEY : 6 HUNDRED BILLION WON

YOUR CURRENT MONEY : 20,422,323,244,221

PLEASE ENTER PARTICIPATION MONEY
◉ MAXIMUM MONEY : 3 TRILLION WON
○ DIRECT INPUT : [ ] TRILLION [ ] HUNDRED MILLION WON

YOUR PLACE IS RESERVED WHILE
YOU DETERMINE PARTICIPATION MONEY
15 SECONDS ARE LEFT FOR RESERVATION TIME

CONFIRM EXIT

Figure 4A

THE MINIMUM PARTICIPATION MONEY OF THIS ROOM IS XXX WON.
PLEASE ENTER PARTICIPATION MONEY AGAIN.

OK

Figure 4B

THE MAXIMUM PARTICIPATION MONEY OF THIS ROOM IS XXX WON.
PLEASE ENTER PARTICIPATION MONEY AGAIN.

OK

Figure 4C

YOUR PARTICIPATION MONEY ENTRY TIME IS OVER.
PLEASE TRY AGAIN.

OK

Figure 5

PAY SUPPLEMENTARY MONEY

ROOM INFORMATION
CURRENT PARTICIPATION MONEY: 3 TRILLION WON

MAXIMUM PARTICIPATION MONEY : 3 TRILLION WON
MINIMUM PARTICIPATION MONEY : 6 HUNDRED BILLION WON

YOUR CURRENT MONEY : 16,582,347,265,291

PLEASE ENTER SUPPLEMENTARY MONEY
◉ MAXIMUM MONEY: 3 TRILLION WON
○ DIRECT INPUT: [ ] TRILLION [ ] HUNDRED MILLION WON

PLEASE DETERMINE SUPPLEMENTARY
MONEY WITHIN WAITING TIME
5 SECONDS ARE LEFT FOR WAITING TIME

CONFIRM EXIT

Figure 6A

THE MINIMUM SUPPLEMENTARY MONEY OF THIS ROOM IS XXX WON.
PLEASE ENTER SUPPLEMENTARY MONEY AGAIN.

OK

Figure 6B

THE MAXIMUM SUPPLEMENTARY MONEY OF THIS ROOM IS XXX WON.
PLEASE ENTER SUPPLEMENTARY MONEY AGAIN.

OK

GAME SUPPORT SYSTEM AND METHOD

CROSS-REFERENCE TO RELATED APPLICATION

This application claims under 35 U.S.C. §119(a) the benefit of Korean Patent Application No. 10-2007-0053585 filed May 31, 2007, the entire contents of which are incorporated herein by reference.

BACKGROUND

1. Technical Field

The present invention relates, in general, to a game support system and method, and, more particularly, to a game support system and method which can designate a part of a user's own game money as a participation money to allow the user to participate in an online game and can supplement the participation money when a certain amount of the designated participation money is spent.

2. Background Art

Recently, with the development of communication and network technology, various types of content provision service using the Internet, for example, chatting, communities, games, and shopping malls, have been provided. In the case of game provision service, among various types of content provision service, there is a tendency for the development speed and commercialization speed thereof to rapidly increase due to the increase in the number of customers.

In light of this tendency, many portal sites and online game service providers provide various types of "network online games" in which a user plays a game with other gamers in real time through a computer network. Examples of such network online games may include a Go-Stop game, a poker game, a racing game, a fighting game, a Sutda game, etc.

One of the problems with such network online games is that a user may lose all of his or her own game money even at his first trial in various situations such as where the other party gets a high score, the user's betting fails or the other party's betting succeeds, etc. in the games. In particular, it is easy for beginners to lose all of their game moneys quickly, lose their interest in a game provided by a current portal site or game site, and move to another portal site or game site, thereby decreasing the number of customers of the portal or game site(s).

SUMMARY OF THE DISCLOSURE

Accordingly, the present invention has been made keeping in mind the above problems occurring in the prior art, and one of the objects of the present invention is to provide a game support system and a method thereof allowing users to continue to play a game and preventing them from moving out to another portal or game site by providing users with function to designate a portion of their own game money as a participation money and supplement the participation money if necessary.

In one aspect, there is provided a game support system, comprising a database (DB) server for storing in a DB user information, including information about a user's unique identification and the user's own money; a web server for posting information about a plurality of game rooms; a game processing server for admitting the user to a game room selected by the user among the plurality of game rooms and processing a game in the selected game room; and a participation money designation server for providing an input window to allow the user to designate a part of the user's own money as an amount of participation money for the selected game room, wherein the game processing server processes the game so that a bet is made in the game room on the basis of the participation money designated by the user.

In another aspect, there is provided a game support system, comprising a DB server for storing in a DB user information, including information about a user's unique identification and the user's own money; a participation money designation server for providing an input window to allow the user to designate a part of the user's own money as an amount of participation money for the selected game room; a game processing server for classifying a plurality of channels according to a level and processing a game so that a bet is made in at least one game room provided in each of the channels on a basis of the participation money designated by the user; and a participation money management server for adding to or subtracting from the user's participation money a game money won or lost by the user from a game played in the game room, and storing the resulting participation money, wherein the game processing server processes the game so that a bet is made in the game room within the resulting participation money stored in the participation money management server.

In still another aspect, a game support method is provided, comprising: posting information about a plurality of game rooms; admitting a user to a game room selected by the user; providing an input window to allow the user to input an amount corresponding to a part of his or her own money to designate a user's participation money for the selected game room; and processing a game so that while game money won or lost from the game in the selected game room is added to or subtracted from the designated user's participation money, a bet is made with the resulting participation money.

In a further aspect, a game support method is provided, comprising: providing an input window to allow a user to input an amount corresponding to a part of his or her own money to designate a user's participation money; admitting the user to a game room selected by the user among a plurality of game rooms classified according to a level; adding or subtracting to or from the designated user's participation money a game money won or lost from a game played in the selected game room, and storing the resulting participation money; and processing a game so that, when the user leaves the selected game room and enters a new game room, a bet is made in the new game room with the stored resulting participation money.

The game support systems and methods according to the present invention are configured such that a part of a user's own money can be designated as an amount of participation money to allow the user to participate in a game in the case of online games realized through a network, such as a Go-Stop game and a poker game, and such that the supplementation of the participation money can be supported when all of the designated participation money has been lost, thus not only preventing the user from losing his or her interest in the game when the user's own money has been lost in a specific game, but also allowing the user to continue to play the game with interest by providing an opportunity to make an offer again to the user after the user is mentally stabilized when the user's own participation money is lost.

The above and other features of the invention are discussed infra.

BRIEF DESCRIPTION OF THE DRAWINGS

The above and other objects, features and other advantages of the present invention will be more clearly understood from the following detailed description taken in conjunction with the accompanying drawings, in which:

FIG. 3 is a diagram showing an example of a participation money input window provided by the game support system of FIG. 1;

FIGS. 4A to 4C are diagrams showing examples of a pop-up window displayed when money input into the participation money input window of FIG. 3 deviates from a preset range;

FIG. 5 is a diagram showing an example of a supplementary money input window provided by the game support system of FIG. 1;

FIGS. 6A and 6B are diagrams showing examples of a pop-up window displayed when money input into the supplementary money input window of FIG. 5 deviates from a preset range.

DETAILED DESCRIPTION OF THE PREFERRED EMBODIMENTS

Hereinafter, embodiments of a game support system and method according to the present invention will be described in detail with reference to the attached drawings.

Figure 1:
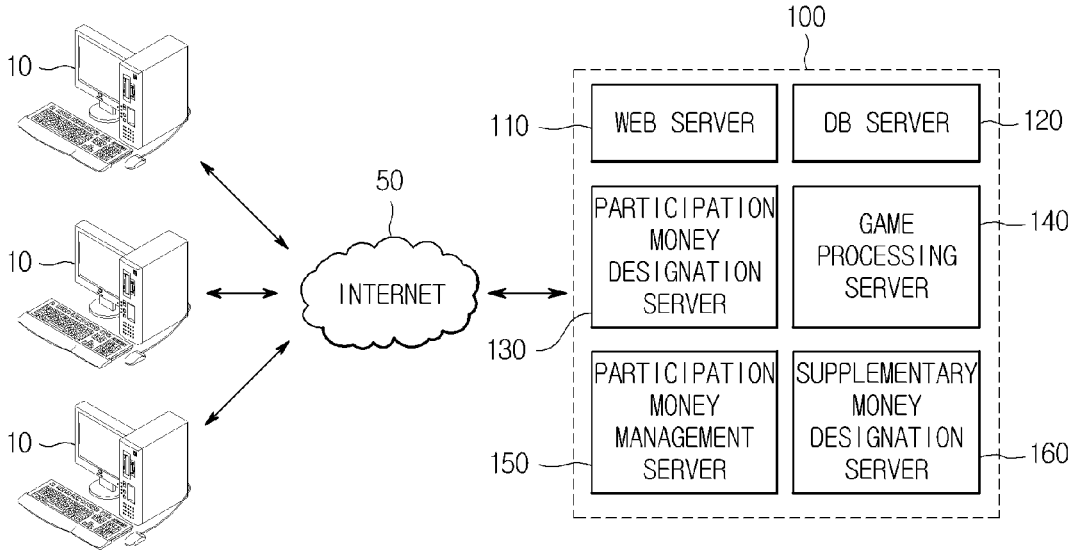
FIG. 1 is a diagram schematically showing a game support system according to a preferred embodiment of the present invention.

FIG. 1 is a block diagram schematically showing a game support system according to a preferred embodiment of the present invention. Referring to the drawing, a user may access a game support system 100 using a computer 10 over the Internet 50. The game support system 100 includes a web server 110, a database (DB) server 120, a participation money designation server 130, a game processing server 140, a participation money management server 150, and a supplementary money designation server 160.

The web server 110 is configured to post various option menus and information. For example, it posts a game item selection menu allowing a user to select a game item, such as a poker game, a Go-Stop game, and a Sutda game, through a web page, a game channel selection menu allowing the user to select a game channel suitable for his or her level in the selected game item, and information about respective game rooms allowing the user to select any one from among a plurality of game rooms established in the selected game channel. Here, the game room information includes information about the total number of persons gathered in each game room, the number of persons currently existing in the game room, the amount of participation money required for a user to participate in the game, and seed money, which is the basis for betting.

The DB server 120 stores in a database user information, including information about the user's unique identification and the user's own money. The term 'user's own money' means the total amount of game money accumulated since the user subscribed as a member.

The participation money designation server 130 provides an input window to allow the user to designate a part of the user's own money as a participation money for participation in a game room selected by the user. Here, the term 'participation money' means basic game money required for the user to play a game in a selected game room, and is used as an available limit in the user's own money. The participation money designation server 130 may be configured to set and store the minimum designated rate and the maximum designated rate of participation money proportional to seed money. When the amount of participation money input into the input window falls within a range of money defined by the set minimum and maximum designated rates, the input participation money is preferably designated as the participation money for participation in the game room. Alternatively, the participation money designation server 130 may be configured to set and store the minimum designated rate and the maximum designated rate of participation money proportional to the user's own money. When the amount of participation money input into the input window falls within a range of money defined by the minimum and maximum designated rates, the input participation money is preferably designated as the participation money for participation in the game room.

The game processing server 140 is configured to admit the user to the game room selected by the user among a plurality of game rooms corresponding to respective channels posted through the web server 110, and to process the game in the selected game room. In this case, the game processing server 140 processes the game so that a bet is made in the game room on the basis of the participation money designated by the user. Further, the game processing server 140 may control the participation money designation server 130 so that an amount of participation money can be newly designated when the user transfers from one game room to another game room. Also, it may be configured such that the user does not need to newly designate a participation money in a new game room. For instance, the participation money, to which or from which game money is added or subtracted, of the previous game room can be used as a participation money for participation in the new game room.

The participation money management server 150 adds or subtracts game money won or lost from the game played in the game room to or from the participation money, and stores the resulting participation money. That is, when the user wins game money from the game played in the game room, the participation money management server 150 adds the earned game money to the participation money while when the user loses game money, it subtracts the lost game money from the participation money.

The supplementary money designation server 160 provides an input window to allow the user to designate a part of the user's own money less the participation money as a supplementary money. Here, the amount of supplementary money that can be input by the supplementary money designation server 160 is preferably implemented to fall within the range of the participation money that can be input through the participation money designation server 130. In this case, the supplementary money designation server 160 can be configured to provide the input window under the control of the game processing server 140 when money, remaining after lost game money is subtracted from the participation money of the user, decreases below a predetermined rate of the participation money initially designated by the user.

Figure 2:
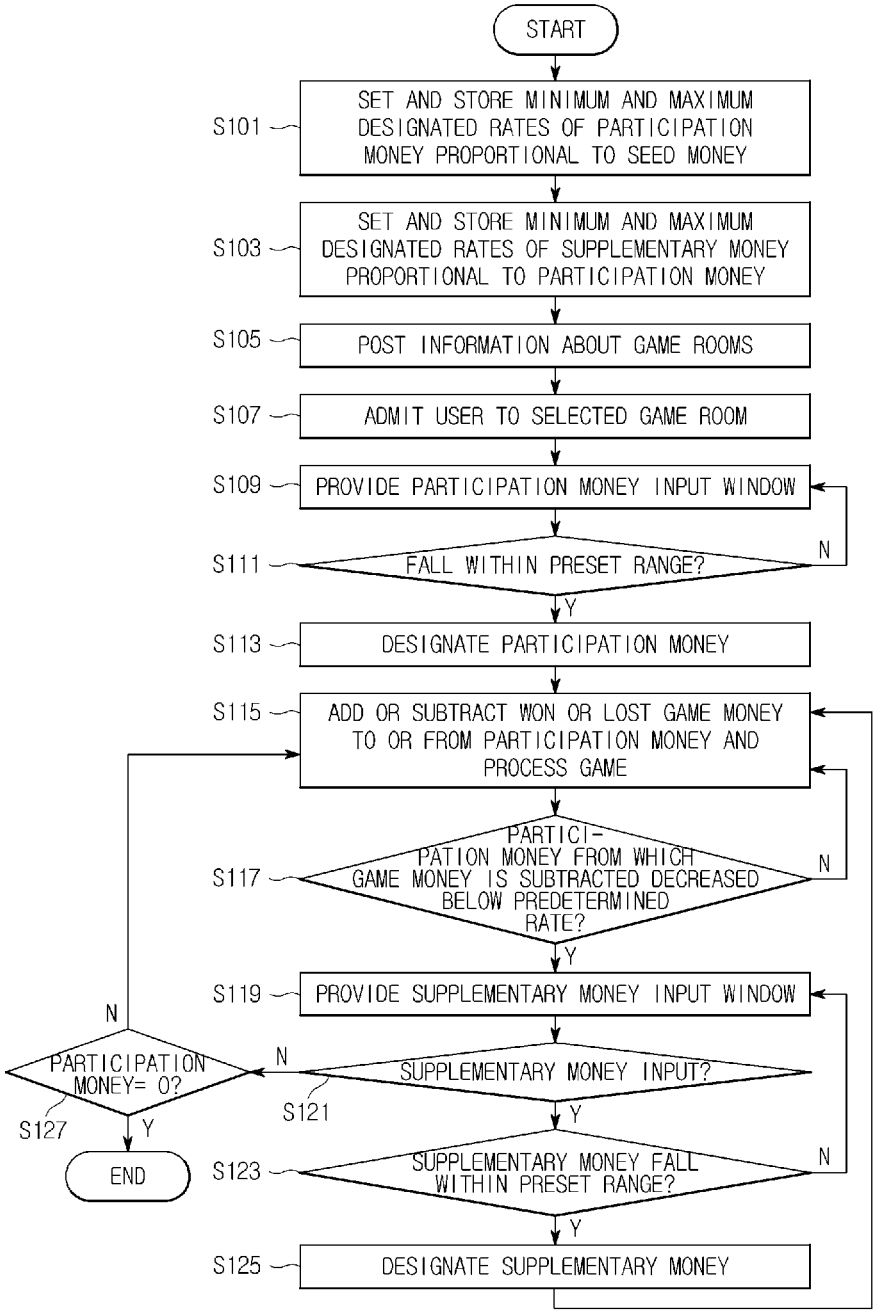
FIG. 2 is a flowchart showing an embodiment of a game support method using the game support system of FIG. 1.

FIG. 2 is a flowchart showing a game support method using the game support system of FIG. 1. With reference to the drawing, the operation and function of the game support system will be described in detail below.

The DB server 120 stores in a database user information, including information about the user's unique identification and the user's own money. Further, the participation money designation server 130 sets and stores the minimum designated rate and the maximum designated rate of participation money proportional to preset seed money at step S101. The supplementary money designation server 160 sets and stores the minimum designated rate and the maximum designated rate of supplementary money proportional to the participation money at step S103. Here, the term 'seed money' means unit money for a bet in a game. The seed money can be provided to increase with the elapse of the play time of the game.

The participation money designation server 130 stores the minimum designated rate and the maximum designated rate of the participation money proportional to seed money. For example, when seed money is two hundred million Korean Won, the minimum designated rate may be stored as 3,000 times and the maximum designated rate may be stored as 15,000 times. In this case, the available range of the participation money defined by the minimum and maximum designated rates is 6 hundred billion Korean Won to 3 trillion Korean Won.

Further, the supplementary money designation server 160 stores the minimum designated rate and the maximum designated rate of the supplementary money proportional to the participation money. In this case, the supplementary money is preferably set within the range of the participation money. For example, the minimum designated rate of the supplementary money can be stored as 0% and the maximum designated rate thereof can be stored as 90%. In this case, the available range of supplementary money defined by the minimum and maximum designated rates is 0 Korean Won to one hundred and eighty million Korean Won. Or, the supplementary money can be designated as a predetermined rate when the participation money from which the lost game money is subtracted decreases below a predetermined rate of the designated participation money.

The web server 110 posts, for example, a game item selection menu allowing the user to select a game item, such as a poker game, a Go-Stop game, and a Sutda game, through a web page, a game channel selection menu allowing the user to select a game channel suitable for his or her level in the selected game item, and information about respective game rooms allowing the user to select any one from among a plurality of game rooms established in the selected game channel at step S105.

When the user selects any one game room on the basis of the information posted on the web page, the game processing server 140 admits the user to the game room selected by the user at step S107, and controls the participation money designation server 130 so that the input window, enabling the input of information, pops up, as shown in FIG. 3, at step S109. In this case, it is preferable to post information about the range of the participation money that can be designated by the user in the participation money input window, together with the participation money.

The user can input an amount of participation money into the input window that is made to pop up by the participation money designation server 130. In this case, the participation money designation server 130 determines whether the amount of the participation money input by the user falls within the preset range of the participation money at step S111. If it is determined that it is less than the lower limit of the preset range of the participation money, the participation money designation server 130 displays the pop-up window of FIG. 4A, thus allowing the user to input money again. On the other hand, when it is greater than the upper limit of the preset range of the participation money, the participation money designation server 130 displays the pop-up window of FIG. 4B, thus allowing the user to input money again. In this case, the participation money designation server 130 can be configured to set and store the participation money input time, and to display the pop-up window of FIG. 4C after the time during which the user can input money into the input window has elapsed.

When the input money falls within the preset range, the participation money designation server 130 designates the input money as a participation money at step S113.

The game processing server 140 processes the game in the game room on the basis of the participation money designated by the participation money designation server 130. When the user wins or loses game money from the game played in the game room, the participation money management server 150 adds or subtracts the game money, won or lost by the user from the game, to or from the designated participation money at step S115.

When the participation money to which or from which the game money is added or subtracted by the participation money management server 150 decreases below a predetermined rate of the participation money designated by the participation money designation server 130 at step S117, the game processing server 140 controls the supplementary money designation server 160 so that the supplementary money input window is displayed at step S119. For example, when the participation money to which or from which the game money is added or subtracted decreases below 10% of the initially designated participation money, the supplementary money designation server 160 can provide the supplementary money input window, as shown in FIG. 5.

When the user inputs an amount of supplementary money into the supplementary money input window at step S121, the supplementary money designation server 160 determines whether the input supplementary money falls within the preset range of the supplementary money at step S123. Similar to the participation money designation server 130, the supplementary money designation server 160 can also be configured to display the pop-up window, as shown in FIG. 6A or 6B, if it is determined that the amount of supplementary money input into the input window deviates from the preset range.

If it is determined that the supplementary money input by the user falls within the preset range, the supplementary money designation server 160 designates the input money as supplementary money at step S125, subtracts the designated supplementary money from the user's own money, and adds the designated supplementary money to the participation money from which game money is subtracted.

When the participation money to which or from which game money is added or subtracted from the game played in the game room becomes 0 Korean Won, for example, at step S127, the user cannot play a game any more in the selected game room, and has to leave the game room or remain merely as a watcher in the game room.

In this way, the user can designate only a part of his or her own money as participation money, thus not only preventing all the user's own money from being lost from one or two games in the selected game room, but also enabling a game to be continuously played in the game room using the amount of supplementary money.

Figure 7:
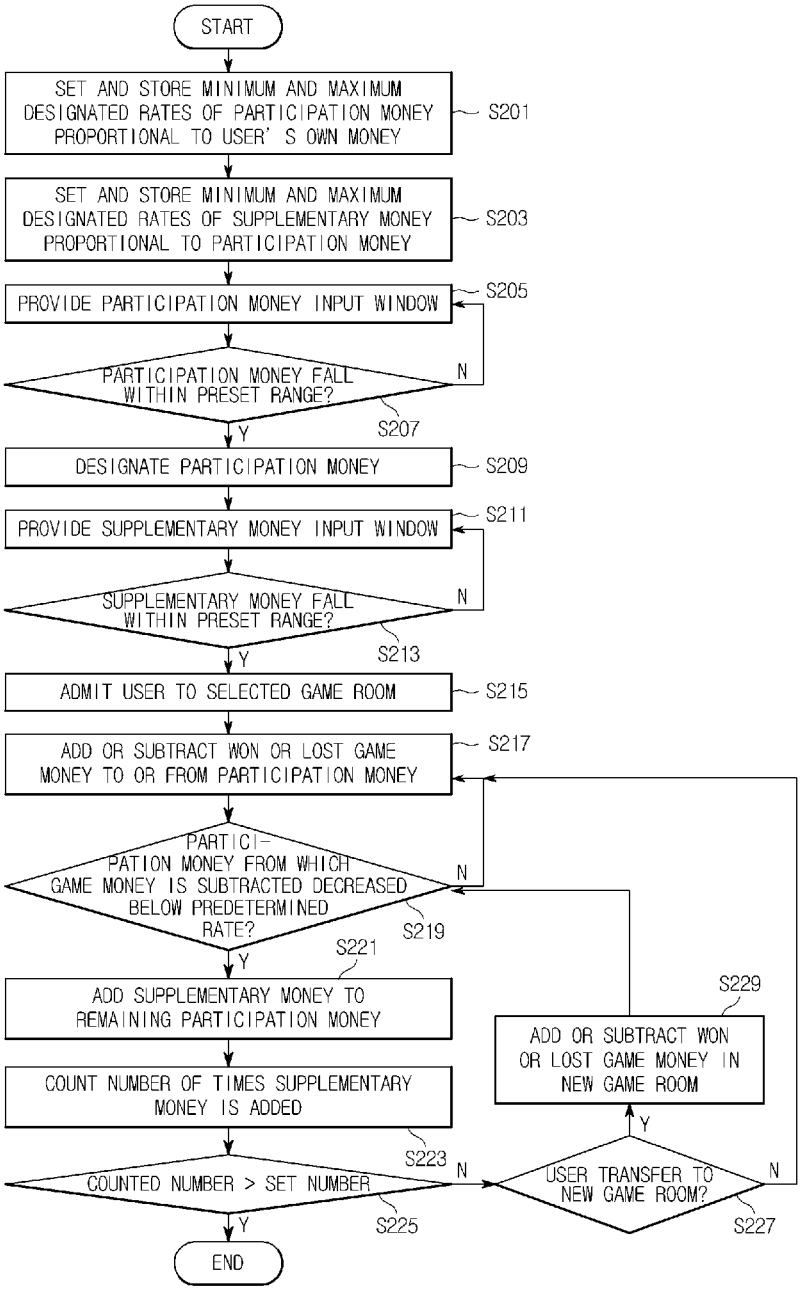
FIG. 7 is a flowchart showing another embodiment of a game support method using the game support system of FIG. 1.

FIG. 7 is a flowchart showing another embodiment of a game support method using the game support system of FIG. 1.

Referring to FIG. 7, the DB server 120 stores in a database user information, including information about the user's unique identification and the user's own money. Further, the participation money designation server 130 sets and stores the minimum designated rate and maximum designated rate of participation money proportional to the user's own money at step S201. The supplementary money designation server 160 sets and stores the minimum designated rate and maximum designated rate of supplementary money proportional to the participation money at step S203.

The participation money designation server 130 provides to the user a participation money input window to allow the user who accesses the game support system 100 to input an amount of participation money at step S205.

When the user inputs an amount of money into the participation money input window, the participation money designation server 130 determines whether the input money falls within the preset range of the participation money defined by the minimum and maximum designated rates, as described above, at step S207, and designates the input money as participation money if it is determined that the input money falls within the preset range of the participation money at step S209.

When the participation money is designated, the supplementary money designation server 160 provides a supplementary money input window to allow the user to input an amount of supplementary money at step S211, and determines whether input money falls within the preset range of the supplementary money defined by the minimum and maximum designated rates, as described above, at step S213.

The game processing server 140 admits the user to the game room selected by the user if it is determined that the input money falls within the preset range of the supplementary money at step S215.

As the game is played in the game room by the game processing server 140, the user wins or loses game money, and the participation money management server 150 adds or subtracts the money won or lost by the user to or from the designated participation money at step S217.

When the participation money from which the game money is subtracted decreases below a predetermined rate of the designated participation money at step S219, the participation money management server 150 subtracts an amount of supplementary money from the user's own money, and adds the supplementary money to the participation money from which the game money is subtracted at step S221. In this case, the participation money management server 150 may be configured to set and store the limited number of times that supplementary money can be added, and to count the number of times that the supplementary money is added to the participation money from which game money is subtracted at step S223. In this case, when the number of times that the supplementary money is added exceeds the set number of times at step S225, the game processing server 140 can stop the game of the user, and can make the user leave the game room or remain merely as a watcher.

If the user transfers from the game room to a new game room when the number of times that the supplementary money is added is equal to or less than the set number of times at step S227, the game processing server 140 processes a game so that the user bets in the new game room within the range of the money stored in the participation money management server 150, that is, the range of the participation money to which or from which won or lost game money is added or subtracted. In this case, the game money won or lost by the user in the new game room is successively added to or subtracted from the participation money remaining through the previous game room at step S229.

As described above, the user can designate only a part of his or her own money as participation money and can continue to play a game within the range of the designated participation money even when transferring from one game room to another game room. Further, since the supplementation of the participation money is possible, the user can properly manage his or her own money.

As shown in the preferred embodiments of the present invention, there are advantages in that a user can designate a part of his or her own money as an amount of participation money, thus not only preventing all of the money from being lost from one or two games played in a selected game room, but also enabling a game to be continuously played in the game room using an amount of supplementary money.

Further, a user can designate a part of his or her own money as an amount of participation money and can continue to play a game within the range of the designated participation money even when transferring from one game room to another game room, and supplementation of participation money enables the user to properly manage his or her own money.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method using a processor, the method comprising:

providing game money information associated with a plurality of games, the game money information comprising a user's own money and participation money, the user's own money being money that is available for the user to play the plurality of games with and is stored on a database in association with the user, and the participation money being money to be used to play a game out of the plurality of games and determined to be part of the user's own money;

determining the game to be played and retrieving seed money of the game, the seed money being a basis for a bet in the game;

setting a range of the participation money by applying a rate to the seed money of the game or applying a rate to the user's own money;

calculating a change of the participation money based on a result of betting of the user;

determining, by the processor, that supplementary money is required for the user to continue to play the game, in response to a determination that the participation money subtracted by lost game money during playing the game is below a threshold amount;

receiving an input of the supplementary money via an input window, the supplementary money being determined to be part of the user's own money and to be less than the participation money; and updating the game money information by subtracting the supplementary money from the user's own money and by adding the supplementary money to the participation money subtracted by lost game money during playing the game.

2. The method according to claim 1, further comprising:

setting the range of the participation money by applying a minimum and maximum rate to the seed money of the game.

3. A computer implemented method using a processor, the method comprising:

providing, to a user, information of the user's own money and enabling the user to select via a first input window participation money out of the user's own money, the user's own money being money that is available for the user to play a plurality of games with and is stored on a database in association with the user, and the participation money being money to be used to play a game out of the plurality of game;

determining the game to be played and retrieving seed money of the game, the seed money being a basis for a bet in the game;

setting a range of the participation money by applying a rate to the seed money of the game or applying a rate to the user's own money;

calculating a change of the participation money based on a result of betting of the user;

determining, by the processor, whether supplementary money is required for the user to continue to play the game based on game money information being detected to be below a threshold amount, the game money information representing participation money subtracted by lost game money during playing the game;

in response to determining that the supplementary money is required, receiving an input of the supplementary money via a second input window, the supplementary money being determined to be part of the user's own money and to be less than the participation money; and updating the game money information by adding the supplementary money to the participation money subtracted by lost game money during playing the game.

4. The computer implemented method according to claim 3, wherein the second input window is further configured to provide information of the user's own money and receive the input of the supplementary money.

5. The computer implemented method according to claim 4, further comprising:

subtracting the supplementary money from the user's own money and adding the supplementary money to the participation money subtracted by lost game money during playing the game.

6. The computer implemented method according to claim 3, further comprising:

setting the range of the participation money by applying a minimum and maximum rate to the seed money of the game.

7. The computer implemented method according to claim 5, further comprising:

counting a number of times that the supplementary money is added; and determining whether the number of times is equal to or exceeds a set number.

8. A non-transitory computer readable storage medium comprising an executable program, which when executed by a processor, instructs the processor to perform the method of claim 1.

9. A game support system comprising a non-transitory storage medium to store user information comprising user identification and a user's own money, a web server configured to provide a plurality of game rooms, and a game server configured to provide the user with a game room among the plurality of game rooms, a game being provided through the game room, the system comprising:

a participation money designation server configured to enable the user to select participation money out of the user's own money via a first input window, the user's own money being money that is available for the user to play in the plurality of game rooms with and is stored on a database in association with the user, and the participation money being money to be used to play in the game room and determined to be part of the user's own money;

a participation money management server configured to determine the game to be played, to retrieve seed money of the game, to set a range of the participation money by applying a rate to the seed money of the game or applying a rate to the user's own money, and to determine whether supplementary money is required for the user to continue to play in the game room based on updated game money information being detected to be below a threshold amount, the updated game money information representing participation money subtracted by lost game money during playing in the game room; and a supplementary money designation server configured to receive an input of the supplementary money via a second input window, the supplementary money being determined to be part of the user's own money and to be less than the participation money, wherein the seed money is a basis for a bet in the game, and the participation money management server is configured to calculate a change of the participation money based on a result of betting of the user.

10. The game support system according to claim 9, wherein the second input window is configured to provide information of the user's own money and receive the input of the supplementary money.

11. The game support system according to claim 10, wherein the supplementary money designation server is further configured to provide the second input window in response to detecting that the participation money subtracted by lost game money during playing in the game room is below a certain ratio of the participation money.

12. The game support system according to claim 9, wherein the participation money designation server is further configured to determine the range of the participation money by applying a minimum rate and a maximum rate to the seed money of the game room.

13. The game support system according to claim 9, wherein the participation money designation server is further configured to determine a range of the participation money by applying a minimum and maximum rate to the user's own money.

14. The game support system according to claim 9, wherein the game server is further configured to process a new game in the game room for the user with the updated game money information.

15. A game support system comprising a non-transitory storage medium to store user information comprising user identification and a user's own money, a web server configured to provide a plurality of game rooms, and a game server configured to provide the user with a game among the plurality of games, the system comprising:

a participation money designation server configured to enable the user to select participation money out of the user's own money via a first input window, the user's own money being money that is available to be used for the user to play the plurality of games, and the participation money being money to be used to play the game and determined to be part of the user's own money;

a participation money management server configured to determine the game to be played, to retrieve seed money of the game, to set a range of the participation money by applying a rate to the seed money of the game or applying a rate to the user's own money, and to determine whether supplementary money is required for the user to continue to play the game in response to detecting that participation money subtracted by lost game money during playing the game is below a threshold amount; and a supplementary money designation server configured to receive an input of the supplementary money via a second input window, the supplementary money being determined to be part of the user's own money and to be less than the participation money, wherein the seed money is a basis for a bet in the game, and the participation money management server is configured to calculate a change of the participation money based on a result of betting of the user.

16. An apparatus using a non-transitory storage medium to store user information comprising user identification and a user's own money and a processor configured to provide the user with a game in a game room among a plurality of game rooms, the apparatus comprising:

a first input window configured to allow the user to select participation money out of the user's own money, the user's own money being money that is available for the user to play in the plurality of game rooms with, and the participation money being money to be used to play in the game room and determined to be part of the user's own money;

the processor configured to determine the game to be played, to retrieve seed money of the game, to set a range of the participation money by applying a rate to the seed money of the game or applying a rate to the user's own money, and to determine whether supplementary money is required for the user to continue to play the game based on updated game money information being detected to be below a threshold amount, the updated game money information representing participation money subtracted by lost game money during playing in the game room; and a second input window configured to receive an input of the supplementary money, the supplementary money being determined to be part of the user's own money and to be less than the participation money, wherein the seed money is a basis for a bet in the game, and the processor is configured to calculate a change of the participation money based on a result of betting of the user.

17. The computer implemented method according to claim 1, wherein the participation money comprises a range of a minimum and maximum amount, and wherein the supplementary money comprises a minimum and maximum amount set based on the user participation money.

18. The computer implemented method according to claim 1, further comprising:

setting a range of the supplementary money by applying a minimum and maximum rate to the participation money of the game.

19. The computer implemented method according to claim 1, wherein a range of first participation money for a first game is determined from the user's own money by applying a rate to seed money of the first game, and a range of second participation money for a second game is determined from the user's own money by applying a rate to seed money of the second game.

* * * * *